US005338123A

United States Patent [19]

Obersteller et al.

[11] Patent Number: 5,338,123

[45] Date of Patent: Aug. 16, 1994

[54] DOUBLE-ENDED PEN

[75] Inventors: Udo Obersteller, Langenhagen; Wilhelm Schlink, Hanover, both of Fed. Rep. of Germany

[73] Assignee: Pelikan GmbH, Hanover, Fed. Rep. of Germany

[21] Appl. No.: 120,896

[22] Filed: Sep. 13, 1993

[30] Foreign Application Priority Data

Sep. 11, 1992 [DE] Fed. Rep. of Germany ..... 4230432

[51] Int. Cl.[5] ..... B43K 27/00; B43K 9/00

[52] U.S. Cl. ..... 401/34; 401/17; 401/20; 401/202; 401/247

[58] Field of Search ..... 401/34, 17, 20, 202, 401/247

[56] References Cited

U.S. PATENT DOCUMENTS 3,252,446 5/1966 Bateman ..... 401/202
4,600,327 7/1986 Guzman ..... 401/34

FOREIGN PATENT DOCUMENTS 811930 10/1951 Fed. Rep. of Germany ..... 401/34
427919 12/1947 Italy ..... 401/34

*Primary Examiner*—Steven A. Bratlie
*Attorney, Agent, or Firm*—Herbert Dubno; Andrew Wilford

[57] ABSTRACT

A double-ended pen has a pair of elongated liquid-holding reservoirs each having a rear end, a front end having a liquid-applying tip, an intermediate portion between the ends and having at the rear end a predetermined relatively small outside diameter, and a snap-type retaining formation. An intermediate coupling sleeve has a pair of oppositely open seats each receiving a respective one of the rear ends and provided with formations for retaining the respective rear ends securely against axial displacement. The sleeve also has a pair of axially opposite ends having axially oppositely directed end surfaces each having a portion extending at an acute angle to a plane perpendicular to the axis. The sleeve ends are of a diameter greater than the outside diameter of the intermediate portions and projecting radially therepast when the respective rear ends are fitted in the seats. A pair of respective caps each adapted to fit over a respective one of the reservoirs each have a rear end substantially of the same diameter as the respective rear end of the sleeve and having an end surface with a surface portion complementary to the inclined portion of the respective sleeve end surface and engageable flush and complementarily therewith in a mounted position of the cap on the respective reservoir. Each cap further has an internal snap-type retaining formation complementary to and engaged with the snap-type retaining formation of the respective reservoir in the mounted position of the cap.

4 Claims, 1 Drawing Sheet

DOUBLE-ENDED PEN

FIELD OF THE INVENTION

The present invention relates to a writing instrument. More particularly this invention concerns a double-ended pen.

BACKGROUND OF THE INVENTION

A double-ended pen typically has a pair of elongated liquid-holding reservoirs each having a rear end, a front end having a liquid-applying tip, and a retaining formation. An intermediate coupling sleeve centered on an axis has a pair of axially oppositely open seats each receiving a respective one of the rear ends and provided with formations for retaining the respective rear ends securely therein against axial displacement relative to the coupling sleeve. A pair of respective caps each adapted to fit over a respective one of the reservoirs each have an internal retaining formation complementary to and engaged with the retaining formation of the respective reservoir in a mounted position of the cap. The reservoirs can hold inks (see U.S. Pat. No. 3,917,416) in which case the tip is fountain, ballpoint, or felt-pen nib, or can contain cover-up or eraser liquids (see U.S. Pat. No. 4,213,717), or even different types of makeup in which case the tip can be a felt wick, a brush, a sponge or other appropriate applicator. Virtually any liquid can be dispensed by such a pen. Furthermore, the one reservoir can hold a supply of pencil leads in which case the tip can be a standard mechanical-pencil nib.

In any case it is important to be able without difficulty to take the cap off the end of the pen that will be used. It is standard, therefore, to provide screwthreads that retain the caps on the respective reservoirs, and the rear ends of the caps abut axially when they are both mounted. Thus the one end of the pen is gripped and the caps are twisted oppositely to remove one of the caps. It is, however, only a fifty-fifty chance that the right cap will unscrew. This is clearly unsatisfactory.

German utility model 7,314,439 describes a system where the caps are snap fitted to the pen. The shaft of the pen is provided with radially outwardly open grooves into which radially inwardly projecting ridges of the caps can fit. Such a system is still relatively disadvantageous since one normally needs a good grip on the pen to pull off one of the caps, and this can result in the wrong cap being pulled off. Furthermore the assembled pen does not present a smooth exterior that facilitates it being inserted into a pocket.

OBJECTS OF THE INVENTION

It is therefore an object of the present invention to provide an improved double-ended pen.

Another object is the provision of such an improved double-ended pen which overcomes the above-given disadvantages, that is which is of attractive and smooth appearance, but where it is easy to take either cap off.

SUMMARY OF THE INVENTION

A double-ended pen has a pair of elongated liquid-holding reservoirs each having a rear end, a front end having a liquid-applying tip, an intermediate portion between the ends and having at the rear end a predetermined relatively small outside diameter, and a snap-type retaining formation. An intermediate coupling sleeve centered on an axis has a pair of axially oppositely open seats each receiving a respective one of the rear ends and provided with formations for retaining the respective rear ends securely therein against axial displacement relative to the coupling sleeve. The sleeve also has a pair of axially opposite ends having axially oppositely directed end surfaces each having at least one portion extending at an acute angle to a plane perpendicular to the axis. The sleeve ends are of a diameter greater than the outside diameter of the intermediate portions and projecting radially therepast when the respective rear ends are fitted in the seats. A pair of respective caps each adapted to fit over a respective one of the reservoirs each have a rear end substantially of the same diameter as the respective rear end of the sleeve and having an end surface with a surface portion complementary to the one portion of the respective sleeve end surface and engageable flush and complementarily therewith in a mounted position of the cap on the respective reservoir. Each cap further has an internal snap-type retaining formation complementary to and engaged with the snap-type retaining formation of the respective reservoir in the mounted position of the cap so that when one of the caps is twisted relative to the sleeve the two surface portions cam the one cap axially off the respective reservoir.

Thus with this system the cap is twisted slightly to cam it axially off the pen. There is a substantial mechanical advantage so that a relatively small force can be used to get the cap off, even though otherwise the cap-retaining formations grip fairly strongly. The coupling sleeve remains exposed between the two end caps so that if the user holds it while twisting one of the caps, this one cap will assuredly be taken off while the other cap will stay on the pen.

According to a feature of this invention the ends of the sleeve are formed as annular sinusoids. This presents a very attractive appearance while ensuring that the caps can be mounted in any of a plurality of angularly offset positions. Since the caps and the mounting sleeve are of the same outside diameter, at least where they abut, the resultant sinus line is an attractive decorative feature, but still the pen has a smooth exterior so that it can be slid easily into a pocket.

The snap-type formations according to the invention each include one radially outwardly open groove and a radially inwardly projecting ridge. Similarly, the formations securing the rear ends of the reservoirs in the sleeve each include a radially open groove and an oppositely radially projecting ridge. The hold of the reservoirs in the sleeve is much stronger than the hold of the clips on the reservoirs, so that the cap can be removed without pulling the respective reservoir out of the sleeve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
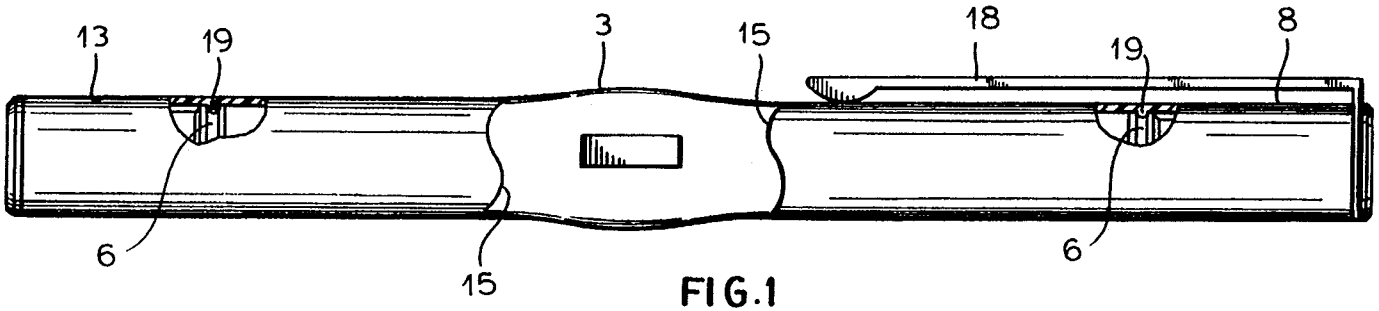
FIG. 1 is a side view partly in section through the double-ended pen according to the invention.

As seen in the drawing a pen according to this invention basically comprises two end parts 1 and 2, a central connecting sleeve 3, and a pair of end caps 8 and 13. The one end part 1 has a cylindrical ink-holding body 5 provided with a standard fountain-pen tip 4 and formed adjacent the tip 4 with an outwardly open groove 6 and, immediately adjacent thereto, with a radially outwardly projecting ridge 7. The other end part 2 has a cylindrical reservoir body 11 holding a supply of eraser liquid and provided with a wick-type tip 12. This part 2 is formed with a groove 6 and ridge 7 identical to that of the part 1. In addition each end part 1 and 2 has a rear end 9 of reduced-diameter cylindrical shape formed immediately adjacent its rear face with a radially outwardly open groove 10.

Figure 2:
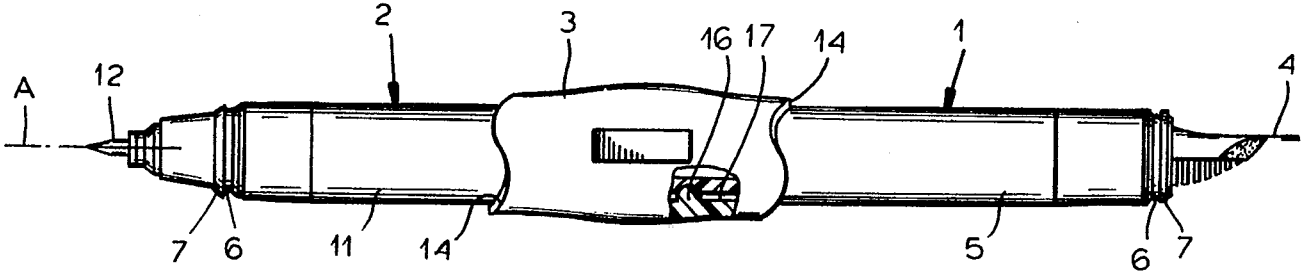
FIG. 2 is a side view of the pen with the caps removed.
Figure 3:
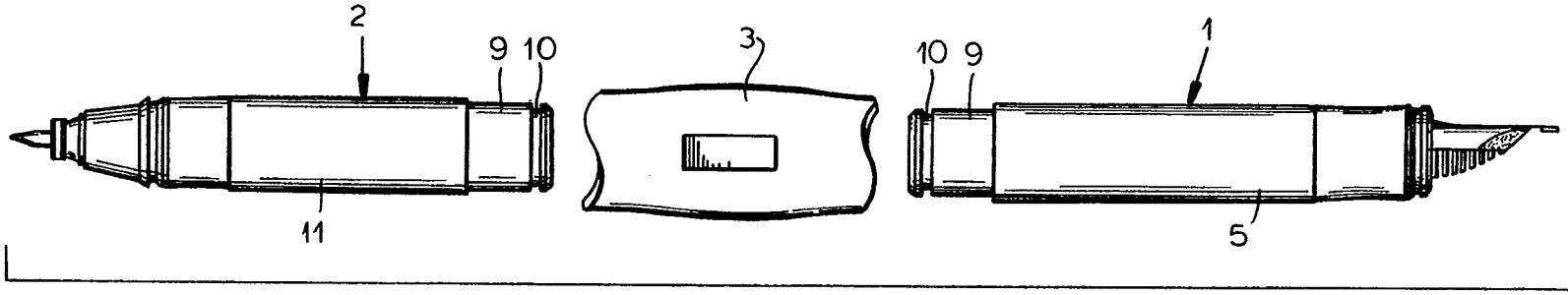
FIG. 3 is an exploded side view of the pen with the caps removed.

The connecting sleeve 3 is formed with a pair of stepped cylindrical outwardly open seats 17 in which the rear ends 9 of the parts 1 and 2 are complementarily received. Inside each such seat the sleeve 3 is formed with a radially inwardly projecting ridge 16. When the rear ends 9 are fitted in the seats 17 the ridges 16 engage very tightly in the grooves 10, locking the parts 1 and 2 in place in the sleeve 3, all centered on an axis A. The outside diameter of the opposite ends of the sleeve 3 is greater than the diameter of the reservoirs 5 and 11 so that when the parts 1 and 2 are fitted into the sleeve 3 as shown in FIG. 2 the sleeve 3 still presents axially oppositely facing end surfaces or edges 14 which are generally sinusoidal, that is wave-shaped.

The caps 8 and 13 are of basically cylindrical shape, the cap 8 being provided with a pocket clip 18. Internally the caps 8 and 13 are hollow and cylindrically tubular and are formed with inwardly projecting annular ridges 19 that form a snug snap fit with the respective grooves 6 when mounted in place as shown in FIG. 1. In addition the caps 8 and 13 are of the same outside diameter as the opposite ends of the sleeve 3 and have sinusoidal end surfaces or edges 15 that fit complementarily with the end edges 14. Thus as seen in FIG. 1 when the caps 8 and 13 are installed they form a smooth continuation of the middle sleeve 3, the surfaces 14 and 15 meeting at a flush joint. Finally, each cap 8 and 13 fits snugly with the respective ridge 7 when mounted so as to prevent the respective tip 4 or 13 from drying out.

To remove, for instance, the cap 8, the user clasps the cap 13 and the middle sleeve 3 in one hand and twists the cap 8. The sinusoidal surfaces 14 and 15 will therefore ride up on each other, forcing the cap 8 axially away from the sleeve 3 in a cam-like action and pulling the ridge 19 of the cap 8 out of the groove 6 of the part 1. Clearly the holding power of the retaining ridge 19 and groove 6 is substantially less than that of the ridge 16 in the groove 10 so that the cap 8 comes off and the whole end part 1 does not and in fact the groove 10 and ridge 16 could be replaced by a more durable holding formation such as a screwthread. The inclined surfaces 14 and 15 offer a substantial mechanical advantage so that the caps 8 and 13 can be removed very easily.

To reinstall the cap 8, it is simply pushed back down over the part 1 and rotated to fit the surfaces 14 and 15 together, thereby allowing the ridge 19 to snap into the groove 6 and reseal that end of the pen. Thus the caps 8 and 13 can be removed and reinstalled easily, but still when installed are securely held in place and present an attractive appearance.

We claim:

1. A double-ended pen comprising:

a pair of elongated liquid-holding reservoirs each having a rear end, both rear ends being substantially identical, a front end having a liquid-applying tip, an intermediate portion between the ends and having at the rear end a predetermined relatively small outside diameter, and a snap-type retaining formation;

an intermediate coupling sleeve centered on an axis and having a pair of axially oppositely open seats each receiving a respective one of the rear ends and provided with means for retaining the respective rear ends securely therein against axial displacement relative to the coupling sleeve, the sleeve having a pair of axially opposite ends having axially oppositely directed end surfaces each having at least one portion extending at an acute angle to a plane perpendicular to the axis, the ends being of a diameter greater than the outside diameter of the intermediate portions and projecting radially therepast when the respective rear ends are fitted in the seats; and a pair of respective caps each adapted to fit over a respective one of the reservoirs and each having a rear end substantially of the same diameter as the respective rear end of the sleeve and having an end surface with a surface portion complementary to the one portion of the respective sleeve end surface and engageable flush and complementarily therewith in a mounted position of the cap on the respective reservoir, an internal snap-type retaining formation complementary to and engaged with the snap-type retaining formation of the respective reservoir in the mounted position of the cap, whereby when one of the caps is twisted relative to the sleeve the two surface portions cam the one cap axially off the respective reservoir.

2. The double-ended pen defined in claim 1 wherein the ends of the sleeve are formed as annular sinusoids.

3. The double-ended pen defined in claim 1 wherein the snap-type formations each include one radially outwardly open groove and a radially inwardly projecting ridge.

4. The double-ended pen defined in claim 1 wherein the retaining means securing the rear ends of the reservoirs in the sleeve each include a radially open groove and an oppositely radially projecting ridge.

* * * * *